US010443451B2

(12) United States Patent
Lefebvre et al.

(10) Patent No.: US 10,443,451 B2
(45) Date of Patent: Oct. 15, 2019

(54) SHROUD HOUSING SUPPORTED BY VANE SEGMENTS

(71) Applicant: Pratt & Whitney Canada Corp., Longueuil (CA)

(72) Inventors: Guy Lefebvre, St-Bruno-de-Montarville (CA); Nicolas Grivas, Dollard-des-Ormeaux (CA); Vincent Paradis, Longueuil (CA)

(73) Assignee: PRATT & WHITNEY CANADA CORP., Longueuil, QC (CA)

( * ) Notice: Subject to any disclaimer, the term of this patent is extended or adjusted under 35 U.S.C. 154(b) by 524 days.

(21) Appl. No.: 15/212,507

(22) Filed: Jul. 18, 2016

(65) Prior Publication Data

US 2018/0016943 A1 Jan. 18, 2018

(51) Int. Cl.

| | |
|---|---|
| ***F01D 25/28*** | (2006.01) |
| ***F01D 25/24*** | (2006.01) |
| ***F01D 9/04*** | (2006.01) |
| ***F01D 5/02*** | (2006.01) |

(52) U.S. Cl.

CPC ..... *F01D 25/28* (2013.01); *F01D 5/02* (2013.01); *F01D 9/041* (2013.01); *F01D 25/243* (2013.01); *F01D 25/246* (2013.01); *F05D 2220/32* (2013.01); *F05D 2230/60* (2013.01); *F05D 2240/80* (2013.01)

(58) Field of Classification Search

CPC . F01D 25/28; F01D 5/02; F01D 9/041; F01D 25/243; F01D 25/246; F05D 2220/32; F05D 2230/60; F05D 2240/80

USPC ..... 415/209.2

See application file for complete search history.

(56) References Cited

U.S. PATENT DOCUMENTS

| | | | |
|---|---|---|---|
| 3,604,629 | A | 9/1971 | Colville |
| 3,617,147 | A | 11/1971 | Bragg |
| 3,704,075 | A | 11/1972 | Karstensen et al. |
| 3,745,629 | A | 7/1973 | Pask et al. |
| 4,478,551 | A | 10/1984 | Honeycutt, Jr. et al. |
| 4,595,340 | A | 6/1986 | Klassen et al. |
| 4,793,770 | A | 12/1988 | Schonewald et al. |
| 4,989,406 | A | 2/1991 | Vdoviak et al. |
| 5,207,556 | A | 5/1993 | Frederick et al. |
| 5,772,400 | A | 6/1998 | Pellow |

(Continued)

FOREIGN PATENT DOCUMENTS

| | | |
|---|---|---|
| GB | 1058759 | 2/1967 |
| GB | 1534124 | 11/1978 |
| GB | 2226600 | 7/1990 |

OTHER PUBLICATIONS

Integrated Strut-Vane Nozzle (ISV) With Uneven Vane Axial Chords, U.S. Appl. No. 14/939,237 filed Nov. 12, 2015.

(Continued)

*Primary Examiner* — Aaron R Eastman

(74) *Attorney, Agent, or Firm* — Norton Rose Fulbright Canada LLP

(57) ABSTRACT

A shroud mounting arrangement comprises a shroud housing and a shroud mounted to the shroud housing. The shroud is configured to surround a stage of rotor blades of a gas turbine engine. A circumferentially segmented vane ring is disposed axially adjacent to the stage of rotor blades. The circumferentially segmented vane ring comprises a plurality of vane segments. The vane segments jointly support the shroud housing.

20 Claims, 4 Drawing Sheets

(56) References Cited

U.S. PATENT DOCUMENTS

| | | | | |
|---|---|---|---|---|
| 6,045,325 | A | 4/2000 | Horvath et al. | |
| 6,082,966 | A | 7/2000 | Hall et al. | |
| 6,331,100 | B1 | 12/2001 | Liu et al. | |
| 6,331,217 | B1 | 12/2001 | Burke et al. | |
| 6,439,838 | B1 | 8/2002 | Crall et al. | |
| 6,619,916 | B1 | 9/2003 | Capozzi | |
| 6,851,264 | B2 | 2/2005 | Kirtley et al. | |
| 6,883,303 | B1 | 4/2005 | Seda | |
| 6,983,608 | B2 | 1/2006 | Allen, Jr. et al. | |
| 7,055,304 | B2 | 6/2006 | Courtot et al. | |
| 7,097,420 | B2 | 8/2006 | Cormier et al. | |
| 7,134,838 | B2 | 11/2006 | Dube et al. | |
| 7,238,003 | B2 | 7/2007 | Synnott | |
| 7,322,797 | B2 | 1/2008 | Lee | |
| 7,544,040 | B2 | 6/2009 | Marke et al. | |
| 7,549,839 | B2 | 6/2009 | Carroll et al. | |
| 7,553,129 | B2 | 6/2009 | Hoeger et al. | |
| 7,753,652 | B2 | 7/2010 | Truckenmueller et al. | |
| 7,985,053 | B2 | 7/2011 | Schott et al. | |
| 8,061,969 | B2 | 11/2011 | Durocher et al. | |
| 8,091,371 | B2 | 1/2012 | Durocher et al. | |
| 8,096,746 | B2 | 1/2012 | Durocher | |
| 8,099,962 | B2 | 1/2012 | Durocher | |
| 8,152,451 | B2 | 4/2012 | Manteiga | |
| 8,182,204 | B2 | 5/2012 | Durocher et al. | |
| 8,192,153 | B2 | 6/2012 | Harvey et al. | |
| 8,197,196 | B2 | 6/2012 | Davis et al. | |
| 8,245,518 | B2 | 8/2012 | Durocher | |
| 8,371,812 | B2 | 2/2013 | Manteiga | |
| 8,425,185 | B2 | 4/2013 | Myoren et al. | |
| 8,678,760 | B2 | 3/2014 | Clemen | |
| 8,684,684 | B2 | 4/2014 | Clements | |
| 8,696,306 | B2 | 4/2014 | Clemen | |
| 8,979,499 | B2 | 3/2015 | Allen-Bradley | |
| 8,997,494 | B2 | 4/2015 | Chuang et al. | |
| 9,068,460 | B2 | 6/2015 | Suciu et al. | |
| 9,115,588 | B2 | 8/2015 | Nash | |
| 9,133,713 | B2 | 9/2015 | Allen-Bradley | |
| 9,175,693 | B2 | 11/2015 | Dutka et al. | |
| 9,243,511 | B2 | 1/2016 | Lee et al. | |
| 9,249,736 | B2 | 2/2016 | Carroll | |
| 9,284,845 | B2 | 3/2016 | Lewis et al. | |
| 10,053,999 | B2 | 8/2018 | McCaffrey et al. | |
| 2002/0197153 | A1* | 12/2002 | Rogers | F01D 9/04 415/137 |
| 2006/0018760 | A1 | 1/2006 | Bruce et al. | |
| 2006/0024158 | A1 | 2/2006 | Hoeger et al. | |
| 2006/0045745 | A1* | 3/2006 | Synnott | F01D 11/003 416/219 R |
| 2006/0127215 | A1* | 6/2006 | Durocher | F01D 9/023 415/191 |
| 2007/0092372 | A1 | 4/2007 | Carroll et al. | |
| 2009/0155068 | A1 | 6/2009 | Durocher et al. | |
| 2009/0155069 | A1* | 6/2009 | Durocher | F01D 9/042 415/209.3 |
| 2009/0324400 | A1 | 12/2009 | Marini et al. | |
| 2010/0080699 | A1 | 4/2010 | Pietrobon et al. | |
| 2010/0111690 | A1 | 5/2010 | Heriz Agiriano et al. | |
| 2010/0132371 | A1 | 6/2010 | Durocher et al. | |
| 2010/0132377 | A1* | 6/2010 | Durocher | F01D 9/047 60/797 |
| 2010/0166543 | A1 | 7/2010 | Carroll | |
| 2010/0166545 | A1* | 7/2010 | Schuler | F01D 25/06 415/189 |
| 2010/0272566 | A1 | 10/2010 | Durocher et al. | |
| 2010/0275572 | A1 | 11/2010 | Durocher et al. | |
| 2013/0142660 | A1 | 6/2013 | McCaffrey | |
| 2013/0259672 | A1 | 10/2013 | Suciu et al. | |
| 2013/0330180 | A1 | 12/2013 | Guendogdu et al. | |
| 2014/0056711 | A1* | 2/2014 | Dezouche | F01D 9/042 416/193 A |
| 2014/0255159 | A1 | 9/2014 | Paradis et al. | |
| 2014/0301849 | A1* | 10/2014 | Snyder | F01D 1/02 416/182 |
| 2015/0044032 | A1* | 2/2015 | Paradis | F01D 25/246 415/134 |
| 2015/0098812 | A1 | 4/2015 | Paradis et al. | |
| 2015/0226075 | A1* | 8/2015 | Aoki | F01D 25/246 415/209.3 |
| 2016/0281509 | A1 | 9/2016 | Pons et al. | |
| 2016/0362994 | A1* | 12/2016 | Anglin | F01D 5/025 |

OTHER PUBLICATIONS

Non-Final Office Action dated Jul. 13, 2016 in related U.S. Appl. No. 13/961,136.

Office Action issued in related U.S. Appl. No. 13/788,474 dated May 16, 2017.

Cited references in Notice of allowance issued in related U.S. Appl. No. 13/961,136 dated Aug. 2, 2017.

* cited by examiner

SHROUD HOUSING SUPPORTED BY VANE SEGMENTS

TECHNICAL FIELD

The application relates generally to gas turbine engine and, more particularly, to a shroud housing support arrangement.

BACKGROUND OF THE ART

Turbine shrouds are used to control rotor tip clearance. If not appropriately control, the rotor tip clearance may have a detrimental impact on the turbine performances. Accordingly, the turbine shroud must be appropriately supported on the engine structure to ensure the integrity of the tip clearance during engine operation. This has proven to be particularly challenging in applications where the operating temperatures do not allow for a unitary vane ring and where circumferentially segmented vane rings are used to accommodate thermal expansion. In such applications, the shroud segments are typically supported from an axially remote location by the turbine support case (TSC). This results in a relatively long structural path between the shroud and its point of attachment to the engine structure. This makes the control of the tip clearance challenging during engine operation.

SUMMARY

In one aspect, there is provided a turbine assembly for a gas turbine engine, the turbine assembly comprising: a shroud housing supporting a circumferential array of shroud segments about a tip of a circumferential array of turbine blades mounted for rotation about an engine axis, and a circumferentially segmented vane ring mounted to an internal structure of the engine axially adjacent to the circumferential array of turbine blades, the circumferentially segmented vane ring including a plurality of vane segments, the vane segments jointly supporting the shroud housing, the shroud housing being axially restrained on the vane segments by a retaining ring.

In another aspect, there is provided a shroud mounting arrangement for a gas turbine engine, the shroud mounting arrangement comprising: a shroud housing, a shroud mounted to the shroud housing, the shroud being configured to surround a stage of rotor blades mounted for rotation about an axis of the engine, a circumferentially segmented vane ring axially adjacent to the stage of rotor blades, the circumferentially segmented vane ring comprising a plurality of vane segments, the vane segments jointly supporting the shroud housing, and a retaining ring axially restraining the shroud housing on the circumferentially segmented vane ring.

In a further aspect, there is provided a method of assembling a turbine shroud about a circumferential array of turbine blades mounted for rotation about an axis of a gas turbine engine, the method comprising: assembling a plurality of vane segments on inner ring structure to form a circumferentially segmented vane ring assembly, mounting a shroud housing to the circumferentially segmented vane ring assembly, the shroud housing projecting axially from the circumferentially segmented vane ring and supporting a plurality of shroud segments configured for placement about a circumferential array of turbine blades.

DESCRIPTION OF THE DRAWINGS

Reference is now made to the accompanying figures in which.

DETAILED DESCRIPTION

Figure 1:
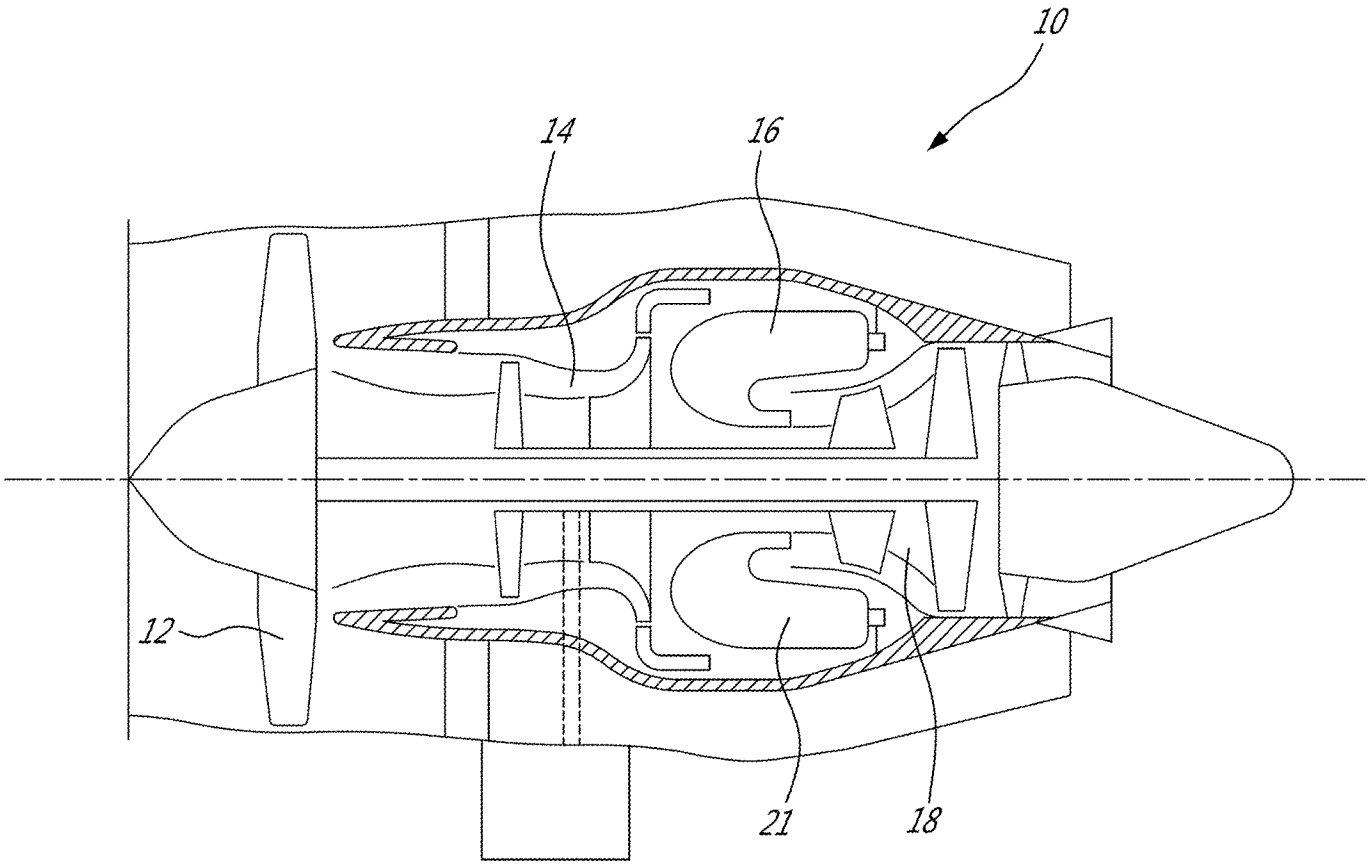
FIG. 1 is a schematic cross-sectional view of a gas turbine engine.

FIG. 1 illustrates a gas turbine engine 10 of a type preferably provided for use in subsonic flight, generally comprising in serial flow communication a fan 12 through which ambient air is propelled, a compressor 14 for pressurizing the air, a combustor 16 in which the compressed air is mixed with fuel and ignited for generating an annular stream of hot combustion gases, and a turbine 18 for extracting energy from the combustion gases.

Figure 2:
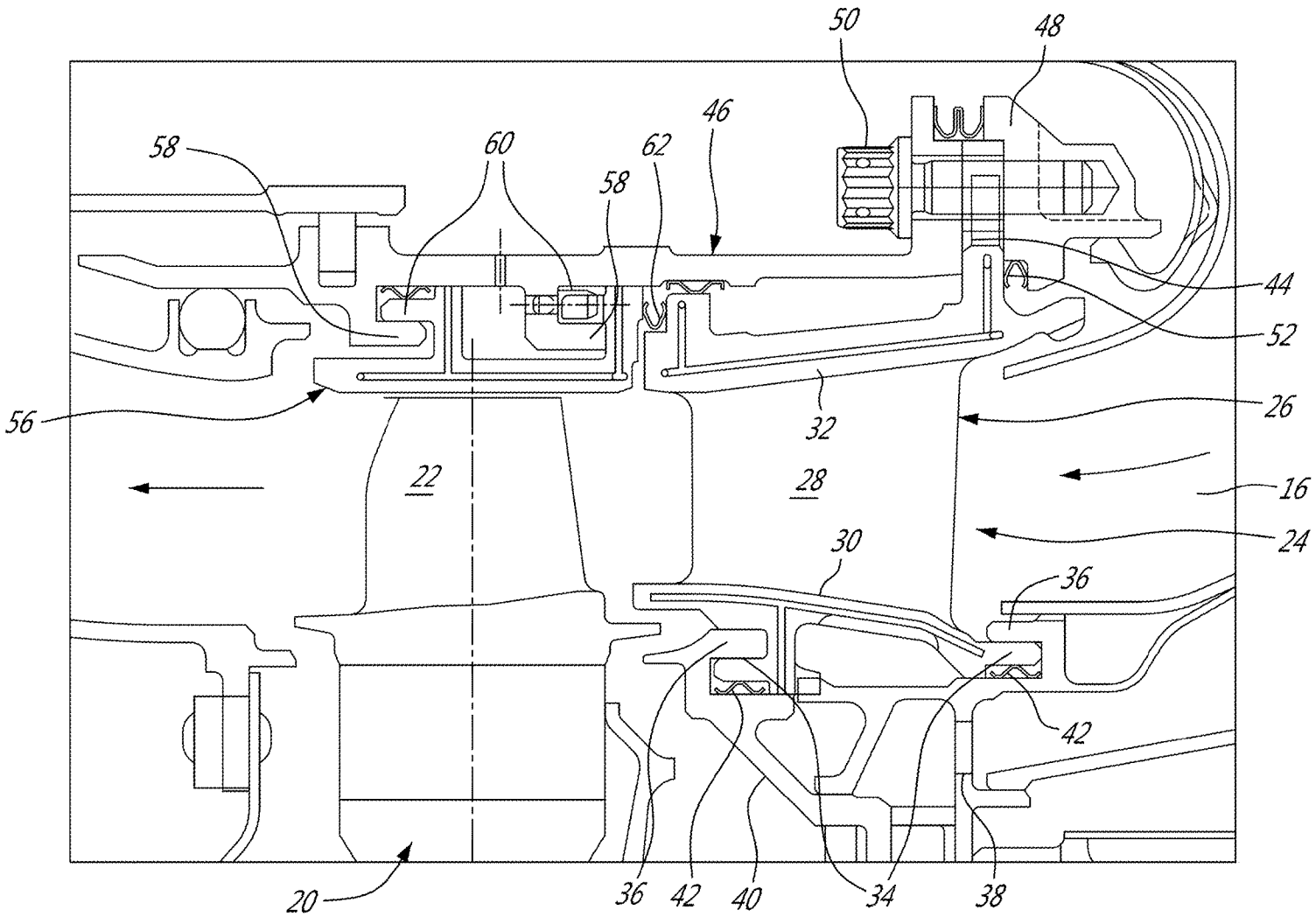
FIG. 2 is a cross-section of a turbine section of the engine and illustrating a first example of a shroud mounting arrangement.

As shown in FIG. 2, the turbine 18 may comprise a high pressure turbine section immediately downstream of the combustor 16. The illustrated exemplary high pressure turbine comprises a first stage rotor 20 including a circumferential array of blades 22 and a stator 24 immediately upstream of the rotor 20 relative to a flow direction across the turbine 18. According to the illustrated embodiment, the stator 24 comprises a circumferentially segmented vane ring. The circumferentially segmented vane ring comprises a plurality of vane segments 26. Each vane segment 26 comprises at least one vane 28 extending between an inner platform 30 and an outer platform 32. Axially extending hooks 34 depend radially inwardly from the inner platform 30 of each vane segment 26. In the illustrated example, the axially extending hooks 34 comprise a forwardly extending hook and a rearwardly extending hook. The hooks 34 are engaged with mating hooks 36 defined in an internal support structure of the engine. As shown in FIG. 2, the internal support structure may be provided in the form of an inner ring 38 and a support cover 40 adapted to be detachably mounted to a downstream face of the inner ring 38 once the vane segments 26 have been mounted to the inner ring 38, thereby axially clamping the vane segments 26 in position. As shown in FIG. 2, spring loaded seals 42 may urge the hooks 34 of the vane segments 26 radially outwardly against a radially inwardly facing surface of the hooks 36 of the internal support structure. The vane segments 26 are, thus, axially and radially retained on the internal structure of the engine 10.

According to the example shown in FIG. 2, each vane segment 26 further has a lug 44 projecting radially outwardly from a flange 49 extending from the back side (i.e. the side opposite the gas path facing side) of an upstream end of the outer platform 32. As will be seen hereinafter, the lug 44 forms part of a lug and slot arrangement for supporting a shroud housing 46. The shroud housing 46 has a tubular body having an upstream end portion configured to be axially fitted over the vane ring assembly 24 from a downstream end thereof. The shroud housing 46 is axially fitted over the segmented vane ring assembly such that a mounting flange at the upstream end of the shroud housing 46 axially abuts against the flange 49 of the vane ring segments 26, as shown in FIG. 2. Circumferentially spaced-apart slots (not shown) are defined in the upstream face of the mounting flange of the shroud housing 46 for receiving the lugs 44. The engagement of the lugs 44 in the slots angularly/circumferentially locks the shroud housing 46 on the vane segments 26. A retaining ring 48 may be fastened to the upstream end of the tubular body of the shroud housing 46 for axially clamping the flange 49 of the vane segments 26 and, thus, axially secure the shroud housing 46 on the vane ring segments 26 after the same has been axially slid thereover. A plurality of circumferentially spaced-apart fasteners 50, such as bolts, is used to adjustably mount the retaining ring 48 to the tubular body of the shroud housing 46. The fasteners extend through corresponding holes defined in the mounting flange circumferentially between the slots receiving the lugs. The lug 44 may terminate short of the slot (just above the axis of the fastener in the illustrated embodiment) to account for thermal expansion of the vane segments relative to the shroud housing. A first spring loaded seal 52 may be installed between the retaining ring 48 and the flange 49, the spring loaded seal 52 exerting an axially urging force on the flange 44 in a downstream direction.

As can be appreciated from FIG. 2, shroud segments 56 are internally mounted in a downstream end portion of the shroud housing 46 about the tip of the rotor blades 22. The shroud segments 56 are held in close proximity to the tip of the blades 22 to define therewith a desired tip clearance. Hooks may be used to mount the shroud segments 56 to the shroud housing 46. According to the illustrated embodiment, a pair of axially extending hooks 58 depends radially inwardly from the radially inner circumferential surface of the shroud housing 46 for mating engagement with corresponding axially extending hooks 60 projecting radially outwardly from the back side of the shroud segments 56. A spring loaded seal 62 may be provided between the shroud segments 56 and the vane segments 26, the spring loaded seal 62 urging the shroud segments in an axially downstream direction.

By axially restraining and supporting the shroud housing 46 on the vane segments 26 adjacent to the rotor blades 22, the impact of shroud housing bending on the tip clearance may be reduced because the shroud segments 56 are very close to the shroud supporting structure. Indeed, any bending induced in the shroud housing 46 will have less impact on the tip clearance than if the shroud support structure was located farther from the turbine blades 22. By reducing the structure path between the shroud segments 56 and the location where the shroud housing 46 is attached to the engine structure, a better control of the tip clearance can be achieved. By minimizing the tip clearance, the engine performances can be improved.

Figure 3:
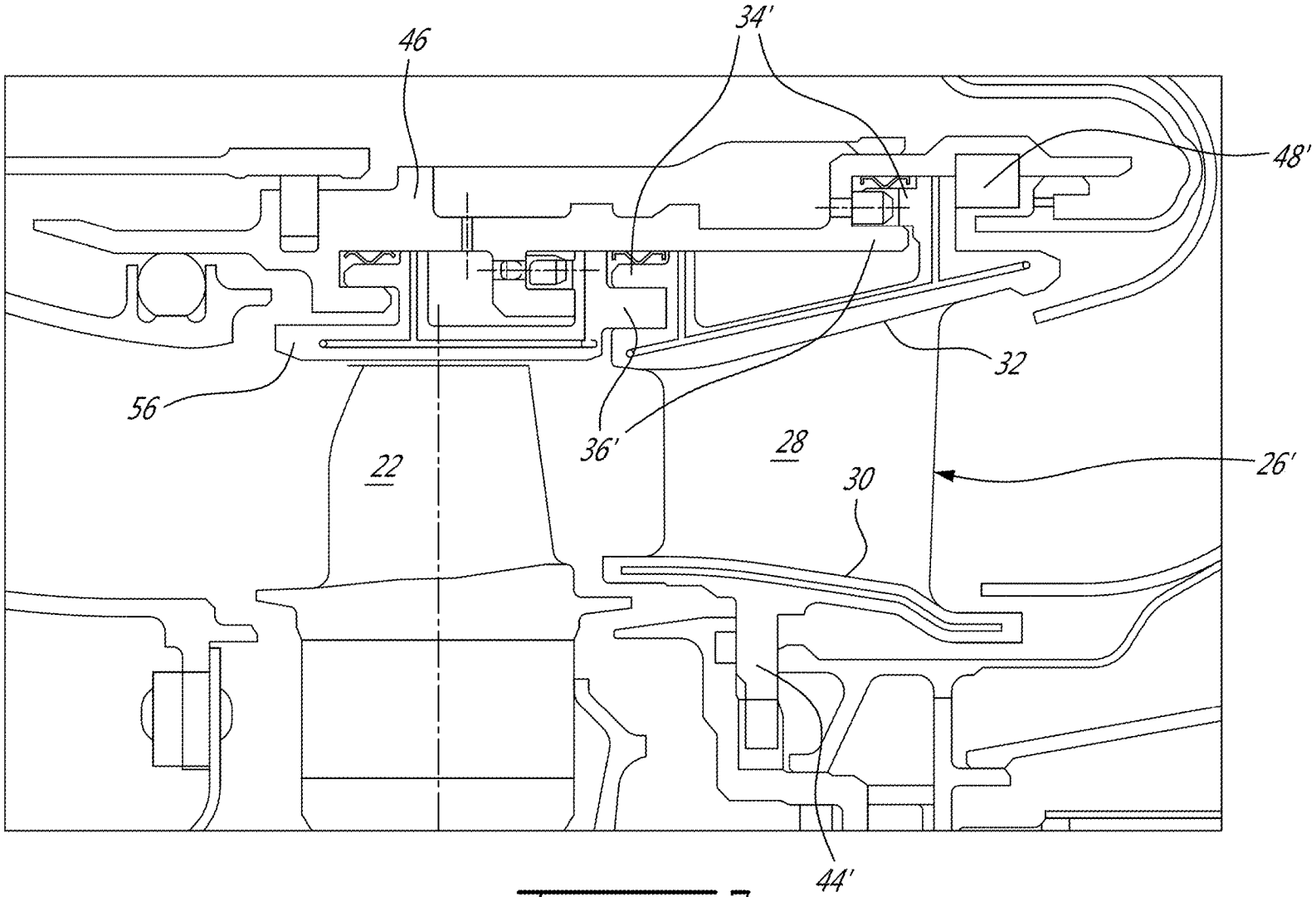
FIG. 3 is a cross-section illustrating a second example of a shroud mounting arrangement.

As shown in FIG. 3, the configuration shown in FIG. 2 can be inverted, i.e. hooks 34' can be provided on the outer platform 32 of the vane segments 26' for engagement with mating hooks 36' on the shroud housing and the shroud segments 56, and the lugs 44' can be provided on the inner platform 30 of the vane segments 26 for engagement with the internal support structure of the engine. The retaining ring 48 can take the form of a retaining ring 48' mounted in a circumferential slot defined in a radially inner surface of an upstream end portion of the shroud housing 46. The retaining ring 48' axially locks the shroud housing to the segmented vane ring assembly. Otherwise, the embodiment shown in FIG. 3 is generally similar to the embodiment shown in FIG. 2 and, thus, a duplicate description thereof will be herein omitted for brevity.

The use of a hook connection on the inner or outer platform of the vane segments and a lug and slot connection on the other one of the inner and outer platforms of the vane segments allows minimizing the looseness in the shroud supporting structure while still allowing for the thermal growth of the vane segments during engine operation.

Figure 4:
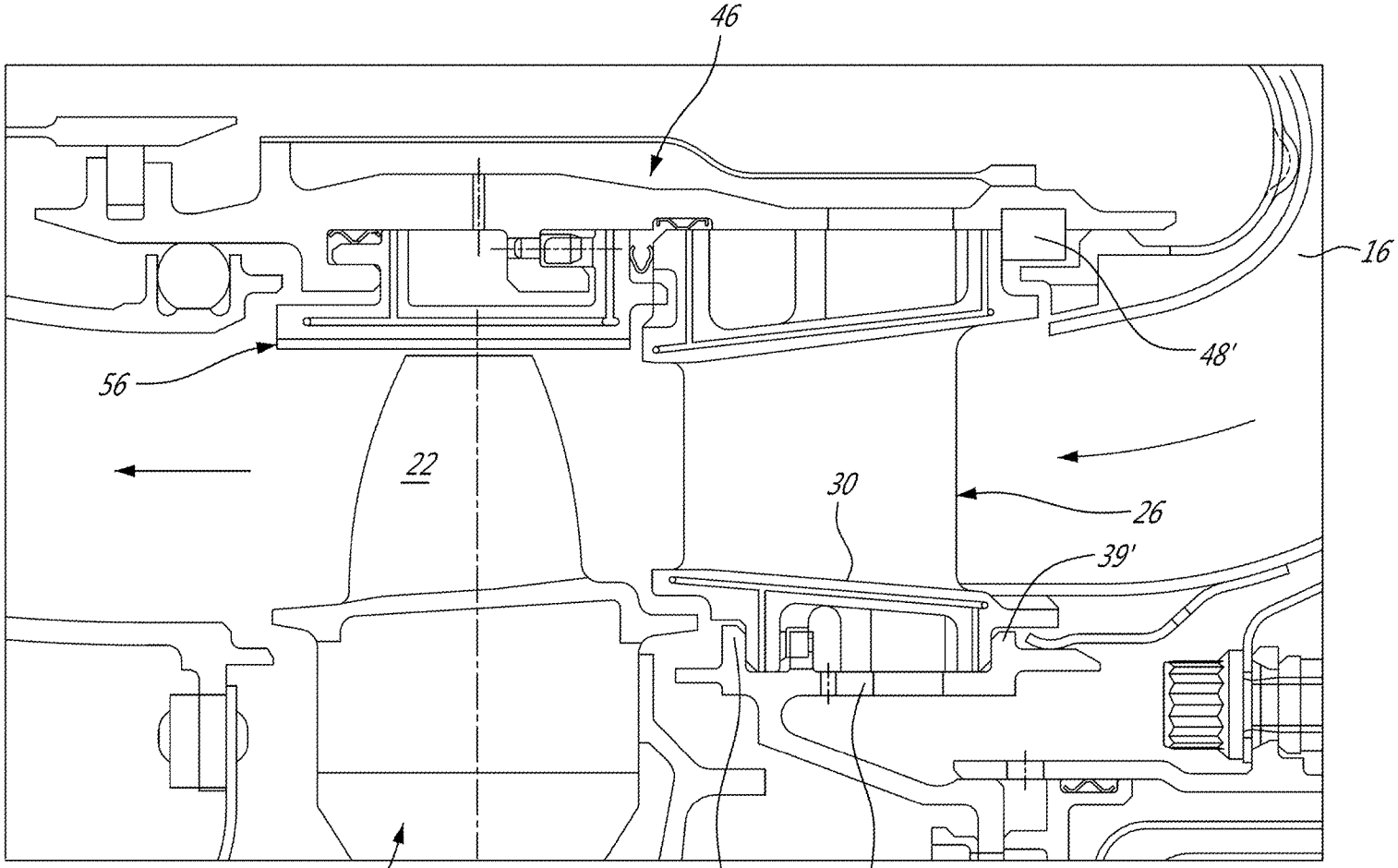
FIG. 4 is a cross-section illustrating a third example of a shroud mounting arrangement.

FIG. 4 illustrates another embodiment in which the vane segments 26 are first assembled on an inner support ring 38'. The inner support ring 38' has an outer circumferential surface and opposed upstream and downstream rims 39' projecting radially outwardly from the outer circumferential surface. The vane segments 26 have a corresponding mating structure depending radially inwardly from the inner platform 30 for engagement between the upstream and downstream rims 39' on the inner support ring 38'. The shroud segments 56 are assembled to the shroud housing 46 as described hereinabove with respect to FIG. 2. The shroud housing 46 is then axially slid over the vane segments 26 mounted on the inner support ring 38'. Thereafter, a retaining ring 48' similar to the one shown in FIG. 3 is engaged is a corresponding groove defined in radially inner circumferential surface of an upstream end portion of the shroud housing 46. The retaining ring 48' secures the final assembly. With this configuration, the carcass bending impact of the shroud housing 46 is reduced and the looseness of the lugs and slots is eliminated, thereby improving tip clearances and engine performances. Also, part count is reduced, reducing cost and weight.

According to one embodiment, a major portion of the weight of the shroud housing is supported by the vane ring assembly. According to another embodiment, the shroud housing is exclusively supported by the vane segments. The shroud housing can be cantilevered from the shroud housing and axially restrained thereon by a retaining ring.

The above description is meant to be exemplary only, and one skilled in the art will recognize that changes may be made to the embodiments described without departing from the scope of the invention disclosed. For example, while the invention has been described in the context of a high pressure turbine section, it is understood that similar shroud mounting arrangement could be used in other sections of the engine. Still other modifications which fall within the scope of the present invention will be apparent to those skilled in the art, in light of a review of this disclosure, and such modifications are intended to fall within the appended claims.

The invention claimed is:

1. A turbine assembly for a gas turbine engine, the turbine assembly comprising: a shroud housing supporting a circumferential array of shroud segments about a tip of a circumferential array of turbine blades mounted for rotation about an engine axis, and a circumferentially segmented vane ring mounted to an internal structure of the engine axially adjacent to the circumferential array of turbine blades, the circumferentially segmented vane ring is axially and radially retained on the internal structure, the circumferentially segmented vane ring including a plurality of vane segments, the vane segments jointly supporting the shroud housing, the shroud housing being axially restrained on the vane segments by a retaining ring.

2. The turbine assembly defined in claim 1, wherein each vane segment has at least one vane extending between inner and outer platforms, and wherein the shroud housing is axially clamped to a mounting structure extending radially outwardly from the outer platform of the vane segments.

3. The turbine assembly defined in claim 2, wherein the shroud housing has an annular body, the retaining ring being mounted to an end portion of the annular body, and wherein the mounting structure comprises a flange and at least one lug extending radially outwardly from the outer platform of each vane segment, the flange being axially clamped between the annular body and the retaining ring, the at least one lug being received in a radial slot between the annular body and the retaining ring.

4. The turbine assembly defined in claim 2, wherein the mounting structure is axially trapped between an axially spring loaded seal positioned between an upstream face of the shroud segments and an axially opposed downstream face of a retaining ring mounted to the shroud housing.

5. The turbine assembly defined in claim 4, wherein the internal structure of the engine comprises an inner ring having an outer circumferential surface and opposed upstream and downstream rims projecting radially outwardly from the outer circumferential surface, the vane segments being axially received between the upstream and downstream rims.

6. The turbine assembly defined in claim 2, wherein the shroud housing has an annular body, an upstream end portion of the annular body being axially fitted over the vane segments, and wherein a retaining ring is engaged in an annular groove defined in a radially inner surface of the upstream end portion of the annular body for axially securing the assembly of the shroud housing over the vane segments.

7. The turbine assembly defined in claim 1, wherein each vane segment has at least one vane extending between inner and outer platforms, the inner and outer platforms having a gas path facing side and an opposed back side, wherein a radially extending flange projects from the back side of a first one of the inner and outer platforms for clamping engagement with the shroud housing or the internal structure of the engine, and wherein axially extending hooks are provided on the back side of a second one of the inner and outer platforms for engagement with a mating hook structure on the shroud housing or the internal structure of the engine.

8. The turbine assembly defined in claim 7, wherein a lug extends from the flange, the lug being received in a slot defined in the shroud housing to form a lug and slot arrangement, and wherein the flange is axially clamped to the shroud housing.

9. The turbine assembly defined in claim 1, wherein each vane segment has at least one vane extending between inner and outer platforms, and wherein a flange projects radially outwardly from the outer platform, the flange and the shroud housing being axially clamped together.

10. The turbine assembly defined in claim 9, wherein the flange is axially clamped between the shroud housing and a retaining ring bolted to the shroud housing.

11. The turbine assembly defined in claim 9, wherein axially extending hooks depend radially inwardly from the inner platform of each vane segment, the hooks being axially clamped between a support cover and the internal structure of the engine.

12. The turbine assembly defined in claim 1, wherein the retaining ring is removably installed in an annular groove defined in a radially inner circumferential surface of the shroud housing.

13. A shroud mounting arrangement for a gas turbine engine, the shroud mounting arrangement comprising: a shroud housing, a shroud mounted to the shroud housing, the shroud being configured to surround a stage of rotor blades mounted for rotation about an axis of the engine, a circumferentially segmented vane ring axially adjacent to the stage of rotor blades, the circumferentially segmented vane ring comprising a plurality of vane segments, the vane segments jointly radially supporting and holding the shroud housing in position, and a retaining ring axially restraining the shroud housing on the circumferentially segmented vane ring.

14. The shroud mounting arrangement defined in claim 13, wherein the shroud housing comprises an annular body having one end portion thereof axially fitted over the circumferentially segmented vane ring, the retaining ring axially securing the shroud housing in position over the circumferentially segmented vane ring.

15. The shroud mounting arrangement defined in claim 14, wherein the retaining ring is mounted in a circumferential groove defined in a radially inner surface of the one end portion of the annular body of the shroud housing.

16. The shroud mounting arrangement defined in claim 14, wherein each vane segment has at least one vane extending between an inner platform and an outer platform, a flange extending radially outwardly from the outer platform, the flange being axially clamped between the annular body of the shroud housing and the retaining ring.

17. The shroud mounting arrangement defined in claim 16, wherein the retaining ring is connected to the annular body by a plurality of circumferentially spaced-apart threaded fasteners.

18. The shroud mounting arrangement defined in claim 16, wherein the vane segments are mounted to an inner ring structure, and wherein axially extending hooks depend radially inwardly from the inner platform of each vane segment, the axially extending hooks being engaged with mating hooks provided on the inner ring structure.

19. The shroud mounting arrangement defined in claim 18, wherein a support cover is adapted to be axially assembled to the inner ring structure, the vane segments being axially trapped between the support cover and the inner ring structure.

20. A method of assembling a turbine shroud about a circumferential array of turbine blades mounted for rotation about an axis of a gas turbine engine, the method comprising: assembling a plurality of vane segments on an inner ring structure to form a circumferentially segmented vane ring assembly; mounting a shroud housing to the circumferentially segmented vane ring assembly, the shroud housing being supported in the gas turbine engine by the circumferentially segmented vane ring assembly; the shroud housing projecting axially from the circumferentially segmented vane ring and supporting a plurality of shroud segments configured for placement about a circumferential array of turbine blades.

* * * * *